United States Patent [19]

McLaughlin

[11] Patent Number: 4,811,764

[45] Date of Patent: Mar. 14, 1989

[54] MEDICATION DISPENSER STATION

[76] Inventor: John T. McLaughlin, 1839 Risa Pl., Glendale, Calif. 91208

[21] Appl. No.: 109,591

[22] Filed: Oct. 19, 1987

[51] Int. Cl.[4] ..... B65D 83/04; A47B 67/02

[52] U.S. Cl. ..... 141/98; 141/104; 141/105; 221/2; 221/3; 221/4; 221/82

[58] Field of Search ..... 141/98, 237, 100, 104, 141/105, 250, 1; 206/538, 539, 533; 221/2, 3, 5, 82, 197

[56] References Cited

U.S. PATENT DOCUMENTS

| | | | |
|---|---|---|---|
| 2,512,961 | 6/1950 | Morrison | 62/391 |
| 2,792,147 | 5/1957 | Stewart | 221/82 |
| 3,638,688 | 2/1972 | Conklin et al. | 141/98 |
| 3,727,794 | 4/1973 | Di Franco | 221/3 |
| 3,744,672 | 7/1973 | Dangles et al. | 221/82 |
| 3,762,601 | 10/1973 | McLaughlin | 221/2 |
| 3,822,004 | 7/1974 | Bolen, Jr. | 221/3 X |
| 3,998,356 | 12/1976 | Christensen | 221/2 |
| 4,207,992 | 6/1980 | Brown | 221/82 X |
| 4,473,884 | 9/1984 | Behl | 264/479 |
| 4,512,500 | 4/1985 | Belbin, Sr. | 221/82 |
| 4,572,403 | 2/1986 | Benaroya | 222/3 |
| 4,573,606 | 3/1986 | Lewis et al. | 221/2 |
| 4,598,742 | 7/1986 | Taylor | 141/95 |
| 4,747,514 | 5/1988 | Stone | 221/82 X |

*Primary Examiner*—Ernest G. Cusick

*Attorney, Agent, or Firm*—Kelly, Bauersfeld & Lowry

[57] ABSTRACT

A medication dispenser station is provided for controlled access to and dispensing of a plurality of different medications. The dispenser station comprises a lockable cabinet containing multiple medication-containing cassettes associated respectively with the different medications and mounted in a vertical stack, with the cassettes having aligned discharge openings cooperatively defining an open discharge chute. Each cassette includes a tray supporting a respective one of a plurality of rotatable carousels having vertically open compartments preloaded with individual doses of a respective one of the different medications. A control unit for the dispenser station responds to appropriate data input using an externally accessible keypad to rotate a selected carousel within its associated tray to sweep the medication within one of the carousel compartments into the discharge chute. The thus-selected medication falls through the chute into an externally accessible receiver to permit removal from the dispenser station for administration to a patient.

17 Claims, 2 Drawing Sheets

FIG. 4
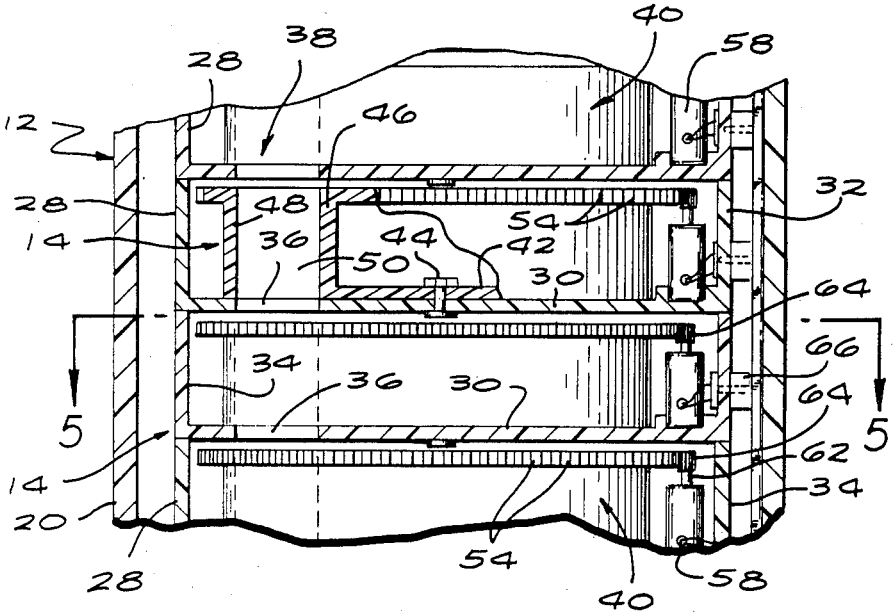
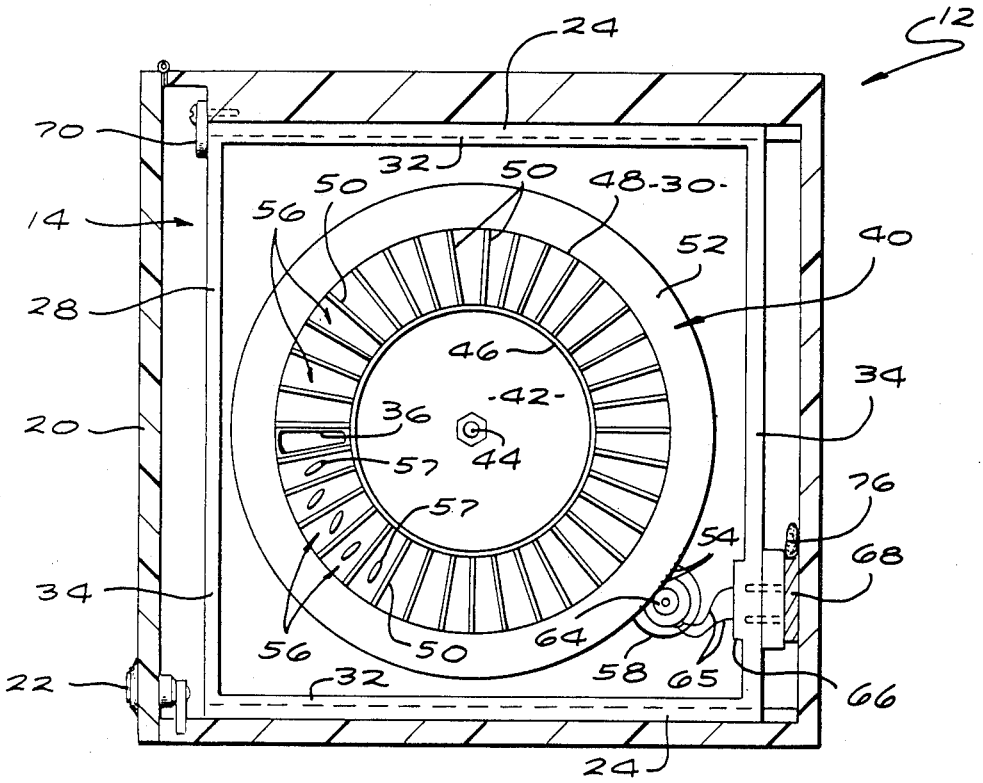
FIG. 5

MEDICATION DISPENSER STATION

BACKGROUND OF THE INVENTION

This invention relates generally to apparatus for use in dispensing medication particularly in tablet or capsule form or the like for administration to a patient. More specifically, this invention relates to an improved medication dispenser station designed to safeguard a group of different medications against unauthorized access while permitting access by authorized personnel.

In a hospital environment, patients commonly require administration of a wide range of different medications in accordance with the medical treatment and/or condition of each individual patient. For example, many patients require administration of one or more medications in accordance with scheduled time intervals throughout a given day. Alternatively, or in addition, patients may require administration of other medications such as pain relievers, decongestants, etc., on an unscheduled, as needed basis. The relative complexities involved in administering many different medications to different patients creates a significant potential for human errors such as administration of an incorrect medication to a patient. Similar potential problems arise, of course, at other medical institutions such as nursing home facilities and the like.

More particularly, in the past, patient medications have traditionally been delivered from the pharmacy of a hospital or other medical institution to a centralized patient floor location for restricted access limited to a nurse or other authorized personnel. Medications are then selected from this centralized stock of medications for administation to patients, normally in accordance with written instructions provided by the attending physician. However, this approach relies heavily upon human selection and sorting of medications for administration purposes, with the unfortunate result that errors in terms of medication type or dosage sometimes occur. Moreover, maintenance of medications in a centralized stock has not satisfactorily protected the medications against unauthorized access and pilferage, especially with respect to narcotic type substances.

A variety of medication dispensing devices have been proposed over the years in attempts to increase the reliability and accuracy of medication administration to patients. The majority of these devices have incorporated timing apparatus with appropriate alarms to signal when medication administration to a patient is due. However, devices of this type still rely upon human selection and sorting of medications, with the result that administration errors can still occur. Moreover, in this type of device, separate devices are normally required for each patient, resulting in a relatively costly system requiring a large number of the dispensing devices to be purchased and thereafter programmed and filled on a regular basis. Still further, in many of these dispensing devices, access to medications loaded therein has not been satisfactorily restricted to authorized personnel.

Other types of medication dispensing devices have been proposed, for example, such as a centralized dispenser on a hospital patient floor or the like for dispensing a plurality of different medications upon operation by an authorized staff member. This type of device beneficially avoids the need for the staff person to distinguish the visual appearances of different medications for selection and sorting purposes, thereby reducing mix-ups in administration of medication to patients.

However, such devices have been relatively complex in construction and operation, resulting in relatively costly products which have not been adopted for use on any widespread basis.

There exists, therefore, a significant need for an improved medication dispensing apparatus having the capability to dispense a variety of different medications in an accurate and reliable manner, wherein the apparatus is relatively simple in construction and operation. The present invention fulfills these needs and provides further related advantages.

SUMMARY OF THE INVENTION

In accordance with the invention, an improved medication dispenser station includes a plurality of medication-containing cassettes which are individually preloaded with a corresponding plurality of different medications, typically in tablet or capsule form. The cassettes are locked into the dispensing station for limited access to authorized personnel upon entry of appropriate data by use of an externally accessible keypad or the like. During such access, a selected cassette containing a selected medication is operated to dispense a single medication dose into an open discharge chute for passage to an externally accessible receiver.

In the preferred form of the invention, the dispenser station comprises a cabinet having an interior subjected to limited access via a lockable door. The cabinet interior includes a plurality of cassette brackets for slide-fit mounting of a plurality of the cassettes in a vertical stack. These cassettes are normally locked against access when the cabinet door is closed and locked.

Each cassette comprises a shallow tray having track means along opposite sides thereof for slide-fit mounting with an associated one of the cassette brackets within the cabinet. In addition, each tray includes a tray floor having a discharge opening formed therein, with the discharge openings of the plurality of trays being vertically aligned to define the open discharge chute when said trays are installed into the cabinet. This discharge chute is vertically aligned in turn with the externally accessible receiver, such as an externally open well for receiving a cup or the like into which dispensed medication will fall.

Each tray supports an annular carousel for rotation upon the tray floor, wherein the carousel is preloaded with a selected medication in individual doses. In a preferred form, the carousel has a plurality of radially oriented partitions defining a plurality of vertically open compartments, each of which is preloaded with a dose of the selected medication. Drive means are associated with each carousel for rotatably driving the carousel within its associated tray.

The keypad on the cabinet is coupled to a control unit for controlling operation of the dispenser station. More particularly, upon entry of appropriate data such as a personnel identification code and coded information corresponding with a particular selected medication, the control unit operates the drive means to rotate a selected carousel within its tray. Such rotation displaces the carousel partitions through a sufficient part-circular path to move one of the compartments into vertical alignment with the discharge chute and thereby sweep one dose of the selected medication into the chute. This medication dose falls through the chute to the receiver where the medication can be removed from the machine and administered to a patient.

In accordance with further aspects of the invention, the control unit includes memory means for recording of data such as the time, date and type of medication dispensed, together with information identifying the person obtaining the medications for patient administration. In addition, the control unit may include means for monitoring the quantity of medication remaining in each cassette, in combination with means for indicating when any of the cassettes are at or near an empty condition.

Other features and advantages of the invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is an enlarged fragmented vertical sectional view taken generally on the line 4—4 of FIG. 2; and FIG. 5 is a horizontal sectional view taken generally on the line 5—5 of FIG. 4.

DETAILED DESCRIPTION OF THE PREFERRED EMBODIMENT

Figure 1:
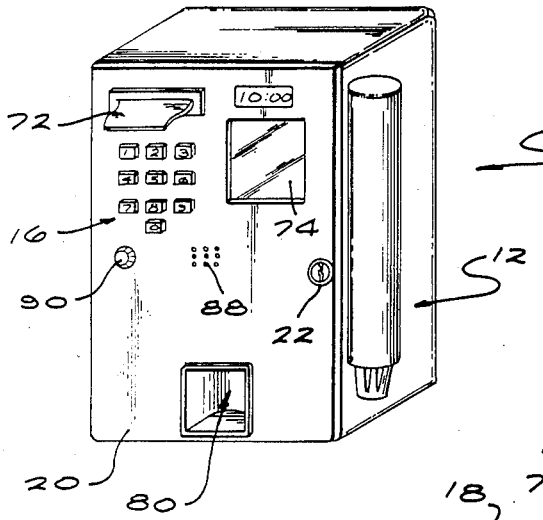
FIG. 1 is a perspective view illustrating a medication dispenser station embodying the novel features of the invention.
Figure 2:
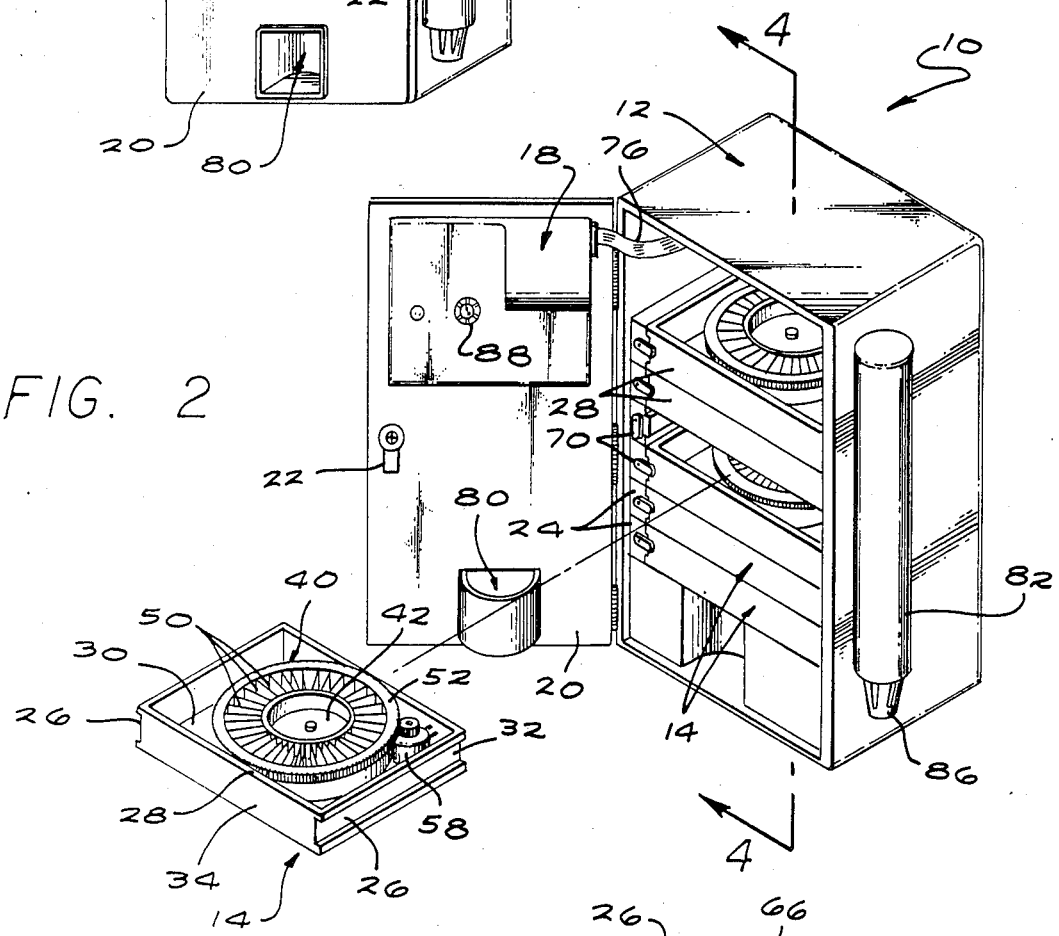
FIG. 2 is an enlarged, partially exploded perspective view depicting the dispenser station in an open condition.
Figure 3:
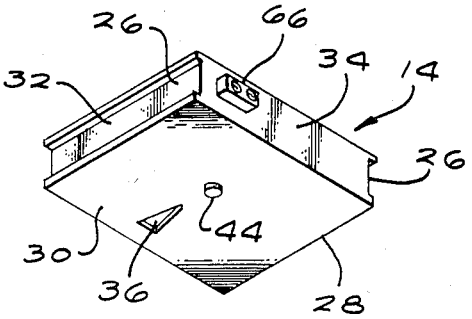
FIG. 3 is a perspective view showing the underside of a medication-containing cassette for use in the dispenser station.

As shown in the exemplary drawings, an improved medication dispenser station referred to generally in FIGS. 1 and 2 by the reference numeral 10 is provided for controlled dispensing of a plurality of medications, particularly such as prescription tablets or capsules commonly dispensed in the environment of a hospital or other medical institution. The station 10 comprises a cabinet 12 encasing a stack of individual cassettes 14 (FIG. 2) each preloaded with a different one of a plurality of different medications. A keypad 16 on the outside of the cabinet 12 provides limited or restricted access to the medications for controlled dispensing and administration to a patient.

The medication dispenser station 10 is designed particularly for use in a hospital environment or the like wherein a group of different medications are required relatively frequently for administration to patients in accordance with individual medical requirements of the patients. The station 10 includes the multiple cassettes 14 adapted for preloading with respective different medications by expert personnel or by automated means (not shown), for example, in a pharmacy by trained pharmacy personnel. The multiple cassettes 14 and loaded and locked into the cabinet 12 to prevent general direct access to those medications by patients or by any other person, including persons such as nursing personnel who are otherwise normally authorized to access medications. Instead, the medications are accessible in a restricted manner by entry of appropriate data using the keypad 16, wherein such data will typically include personnel identification and medication specification codes. The keypad 16 inputs this data to a control unit 18 (FIG. 2) which responds by operating the station 10 to dispense the requested medication in an accurate and reliable manner.

As shown generally in FIGS. 1 and 2, in one preferred form of the invention, the dispenser station 10 comprises the cabinet 12 having a relatively compact overall size and shape for convenient mounting at a typically centralized location on the patient floor of a hospital or other medical facility. The cabinet 12 includes a hinged door 20, shown as a front door, which cooperates in the closed position with other wall components of the cabinet to define a substantially enclosed cabinet interior. The hinged door 20 is designed for swinging movement between a normally closed position (FIG. 1) and an open position (FIG. 2), with the latter position permitting access to the cabinet interior to load or unload the medication-containing cassettes 14, as will be described in more detail. A lock 22 is provided on the door 20 for normally locking the door in the closed position to prevent unauthorized access to the medications contained in the cabinet.

The cabinet 12 is designed for relatively easy, preferably slide-fit reception of a selected number of the medication-containing cassettes 14, with six of said cassettes 14 being shown in FIG. 2 by way of example. However, it will be understood that other numbers of cassettes may be used with appropriate modification of the cabinet size and shape to accommodate cassette mounting therein.

As shown in FIGS. 2 and 5, the inboard faces of the cabinet side walls include rail brackets 24 disposed in generally horizontally extending and vertically spaced relation to each other, with each rail bracket 24 positioned generally in vertical alignment with a mating rail bracket on the opposite side wall. These rail brackets 24 project short distances into the cabinet interior and are provided with a profile for sliding fit into mating recessed tracks 26 formed in the opposite sides of the cassettes 14. Accordingly, when the cabinet door 20 is open, a plurality of the cassettes 14 may be installed into the cabinet 12 by sliding the cassette rearwardly with the tracks 26 receiving a vertically aligned pair of the rail brackets 24. With this construction, as viewed in FIG. 2, a plurality of the cassettes 14 can be installed quickly and easily into the cabinet 12 in a vertically stacked array.

Each of the illustrative cassettes 14 comprises a shallow tray 28 having a floor 30 bounded by short upstanding side walls 32 and end walls 34 with the side walls defining the tracks 26 presented in an outboard direction. In addition, and in accordance with one primary aspect of the invention, the floor 30 of each tray is interrupted by a generally wedge-shaped or pie-shaped discharge opening 36 (FIG. 2) formed generally in a laterally centered position near the front end wall 34. Importantly, when the multiple trays 28 are installed into the cabinet 12, the floor openings 36 of the trays are vertically aligned to define cooperatively an open discharge chute 38, as shown best in FIG. 4.

A rotatable carousel 40 is mounted within the tray 28 of each cassette 14. Each carousel 40, in the preferred form, is conveniently constructed from a lightweight molded plastic or the like to include a central disk 42 secured for rotation upon the underlying tray floor 30 by means of a spindle 44 of suitable design. The outer periphery of this central disk 42 is joined to an upstanding inner ring 46 which is coupled in turn to a concentric outer ring 48 by a spaced array of generally radially oriented partitions 50. The upper margin of the outer ring 48 carries an outwardly radiating lip 52 which defines a set of outwardly presented gear teeth 54.

The radially set partitions 50 cooperate with the inner and outer rings 46 and 48 to define a plurality of vertically open compartments 56 disposed in circular array about the central disk 42. These compartments 56 are loaded at a remote location such as a pharmacy or the like with individual doses of a selected medication, such as by placement of a single capsule 57 into each compartment 56, as viewed in FIG. 5. However, during this loading procedure, one of the compartments 56 is aligned over the discharge opening 36 and remains unfilled. In one preferred form, the carousel 40 is provided with thirty six compartments 56, although any other number of compartments can be used.

As shown in FIGS. 2, 4 and 5, each cassette further includes a small drive motor 58 mounted near the rear end wall 34. This drive motor 58 has an upstanding drive shaft 62 which carries a drive gear 64 meshed with the gear teeth 54 on the carousel lip 52. Conductors 65 couple the drive motor 58 to a fitting 66 mounted through the rear end wall 34 of the tray.

In use, the plurality of cassettes 14 are preloaded each with different medications at the pharmacy or the like and then transported to the cabinet 12 for installation therein. The cassettes 14 are mounted within the cabinet 12 in vertical stacked relation, with each tray fitting 66 sliding into coupled relation with a respective mating fitting 68 (FIG. 5) mounted on the inboard side of the cabinet rear wall. Lock tabs 70 at the front of the rail brackets 24 (FIG. 2) can be provided to insure retention of the cassettes 14 with the fittings 66 and 68 engaged. The front door 20 of the cabinet is then closed and locked.

When dispensing of a selected medication is desired, a person such as a nurse authorized for access to the medications enters a predetermined authorization and identification code into the control unit 18, by use of the externally exposed keypad 16. Importantly, the control unit 18 includes appropriate memory means for creating a record of the person accessing the medications and correlative time and date information. The authorized person then enters appropriate data using the keypad 16 to identify the medication being selected. Patient identification information is also entered, if desired. The memory means creates a record of all of the entered information for appropriate read-out as a paper copy 72 (FIG. 1) or by display on a display screen 74 or the like.

When medication is selected, the control unit 18 signals the appropriate cassette 14 to dispense the selected medication corresponding with that cassette. More particularly, the control unit 18 signals the appropriate drive motor 58 via a cable 76 to index the corresponding carousel 40 through a rotational increment corresponding with one compartment 56, wherein the cable 76 couples the designated drive motor to an appropriate electrical power source. Such carousel rotation displaces the array of partitions 50 to sweep one dose of the selected medication into alignment with the discharge opening 36 in the tray floor 30. The medication thus falls by gravity through the chute 38 into a forwardly open receiver 80 formed in the door 20. Conveniently, a paper cup rack 82 may be mounted on the side of the cabinet 12 and includes a supply of paper cups 86 or the like which can be placed into the receiver to catch the falling medication. Importantly, the stacked cassettes are spaced suffficiently close to each other to prevent capsules or tablets of normal size from becoming trapped within or misguided from the chute 38.

In accordance with further aspects of the invention, the control unit 18 can be further adapted to sense when any particular cassette reaches a condition at which all or nearly all of the medication therein has been dispensed. Although various medication detection devices can be used for this purpose, the control unit memory means can simply count the dispense events for each cassette, in accordance with the number of cassette compartments, and then sound an audio alarm 88 and/or energize a visual alarm 90 when any cassette approaches or reaches an empty condition. The display screen 74 can be used to indicate the cassette requiring replacement, whereupon a substitute and fully loaded cassette can be installed into the cabinet by an appropriate pharmacy staff member or the like.

The improved medication dispenser 10 of the present invention thus provides a relatively simple device for safe dispensing of a wide range of medications for administration to patients. The specific requested medication is automatically dispensed, without the need for sorting and selecting of medications by nursing personnel. Moreover, a retrievable record of medication access and dispensing is created.

A variety of modifications and improvements to the dispenser station of this invention will be apparent to those skilled in the art. As one example, the drive motors 58 may be installed permanently within the cabinet 12 for driving the carousels which are removably installed with the cassettes. Accordingly, no limitation is intended by way of the description herein and the accompanying drawings, except as set forth in the appended claims.

What is claimed is:

1. A medication dispenser station, comprising:

a plurality of cassettes each for receiving a respective one of a plurality of different medications in individual doses, each of said cassettes including a discharge opening for discharge passage of the medication therefrom, each of said cassettes comprising a tray having a tray floor with said discharge opening formed therein, and a carousel rotatably supported upon said tray floor, said carousel defining a generally vertically open plurality of compartments arranged in an annular array for rotation over said discharge opening, each of said compartments being adapted to receive an individual dose of medication;

a cabinet;

means for mounting said cassettes within said cabinet in a generally vertical stack, with said discharge openings of said plurality of cassettes being generally vertically aligned to define a generally vertically oriented discharge chute;

driving means for individually driving each of said cassettes to displace a dose of the medication received therein into alignment with said discharge opening whereby the displaced dose of medication falls through said chute when said cassettes are mounted within said cabinet, said driving means comprising a drive motor carried by each of said cassettes, and means for coupling said drive motor for each cassette to a source of power when said cassette is installed into the cabinet;

means for locking said cassettes within said cabinet to prevent direct access thereto from the cabinet exterior;

control means accessible from the exterior of said cabinet to control operation of said driving means for causing any selected one of said cassettes to displace a dose of the medication therein into alignment with said discharge opening; and receiver means accessible from the exterior of said cabinet and positioned at a lower end of said chute whereby medication falling through said chute falls into said receiver means for access from the cabinet exterior.

2. The medication dispenser station of claim 1, wherein said cabinet includes a hinged door swingable between open and closed positions respectively permitting and preventing access to the cabinet interior, said locking means comprising a lock for normally retaining said door in the closed position.

3. The medication dispenser station of claim 2, wherein said receiver means comprises a laterally open well formed on said door, said well being positioned at the lower end of said chute when said door is in the closed position.

4. The medication dispenser station of claim 3, further including a supply of disposable cups for placement one at a time into said well to catch medication falling through said chute.

5. The medication dispenser station of claim 1, wherein the carousel for each of said cassettes includes an outwardly radiating lip terminating in outwardly presented gear teeth, said drive motor including gear means for meshed engagement with and driving of said gear teeth.

6. The medication dispenser station of claim 1, wherein said cassettes and said cabinet include cooperating bracket means for slide-in mounting of said cassettes in a vertical stack into said cabinet.

7. The medication dispenser station of claim 1, wherein said control means comprises an externally accessible keypad on said cabinet, and memory means responsive to input of predetermined coded data entered by operation of said keypad to operate said driving means for causing a selected one of said cassettes to displace a dose of medication therein into said chute.

8. The medication dispenser station of claim 7, wherein said memory means is further responsive to a predetermined personnel identification code as a condition precedent to operation of said driving means.

9. The medication dispenser station of claim 7, wherein said control means further includes means for creating a readable record of medications dispensed.

10. The medication dispenser of claim 7 wherein said control means further includes means for monitoring the quantities of medications remaining in said cassettes, and for activating alarm means when the quantity of medication in any one of said cassettes reaches a predetermined low level.

11. A medication dispenser station, comprising:

a cabinet having a door movable between open and closed positions to respectively permit and prevent access to the cabinet interior;

a plurality of cassettes each including a tray having a tray floor with a discharge opening therein, and a carousel defining a plurality of generally vertically open compartments arranged in an annular array for rotation through a position overlying said discharge opening;

said carousels of said plurality of cassettes being adapted to be loaded with a respective plurality of different medications by loading individual doses of said medications into said carousel compartments;

means for mounting said cassettes within the interior of said cabinet in a vertically stacked array with said discharge openings cooperatively defining an open vertical chute;

means for selectively locking said door in said closed position to preclude direct access to said cassettes within said cabinet;

means defining an externally accessibly receiver at a lower end of said chute; and control means for rotating a selected one of said carousels through a rotational increment sufficient to displace said compartments of said selected carousel to sweep a dose of the medication therein into said chute, whereby the medication dose falls through said chute into said receiver for access from the exterior of the cabinet, said control means comprising a plurality of drive motors individually associated with and carried by said cassettes, and means for coupling said drive motor for each cassette to a power source when said cassette is mounted into the cabinet.

12. The medication dispenser station of claim 11 wherein said control means is operable from the exterior of said cabinet.

13. The medication dispenser station of claim 11 wherein said cassettes and said cabinet include cooperating bracket means for slide-in mounting of said cassettes in a vertical stack into said cabinet.

14. The medication dispenser station of claim 11 wherein said control means comprises an externally accessible keypad on said cabinet, and memory means responsive to input of predetermined coded data entered by operation of said keypad to operate said control means for causing a selected one of said cassettes to displace a dose of medication therein into said chute.

15. The medication dispenser station of claim 14 wherein said control means further includes means for creating a readable record of medications dispensed.

16. The medication dispenser station of claim 14 wherein said control means further includes means for monitoring the quantities of medications remaining in said cassettes, and for activating alarm means when the quantity of medication in any one of said cassettes reaches a predetermined low level.

17. A medication dispenser station, comprising:

a cabinet;

a plurality of cassettes each for receiving a respective one of a plurality of different medications in individual doses, each of said cassettes including a discharge opening for discharge passage of the medication therefrom;

means for mounting said cassettes within said cabinet in a generally vertical stack, with said discharge openings of said plurality of cassettes being generally vertically aligned to define a generally vertically oriented discharge chute; and driving means for individually driving each of said cassettes to displace a dose of the medication received therein into alignment with said discharge opening whereby the displaced dose of medication falls through said chute when said cassettes are mounted within said cabinet, said driving means comprising a drive motor carried by each of said cassettes, and means for coupling said drive motor for each cassette to a source of power when said cassette is installed into the cabinet.

* * * * *